United States Patent [19]

Hayashi et al.

[11] Patent Number: 4,737,042

[45] Date of Patent: Apr. 12, 1988

[54] PRINTING HEAD WITH SPRINGS FOR PIVOTABLY HOLDING PRINTING HAMMERS

[75] Inventors: Mikio Hayashi; Koichi Kimura, both of Tokyo, Japan

[73] Assignee: Seikosha Co., Ltd., Tokyo, Japan

[21] Appl. No.: 866,581

[22] Filed: May 22, 1986

[30] Foreign Application Priority Data

May 23, 1985 [JP] Japan ..... 60-111257

[51] Int. Cl.[4] ..... B41J 3/12

[52] U.S. Cl. ..... 400/124; 101/93.05

[58] Field of Search ..... 400/124; 101/93.05; 335/274, 275

[56] References Cited

U.S. PATENT DOCUMENTS

| | | | |
|---|---|---|---|
| 4,225,250 | 9/1980 | Wagner | 400/124 |
| 4,348,120 | 9/1982 | Isobe | 400/124 |
| 4,518,269 | 5/1985 | Akazawa | 400/124 |

*Primary Examiner*—Paul T. Sewell

*Attorney, Agent, or Firm*—Bruce L. Adams; Van C. Wilks

[57] ABSTRACT

A plurality of radially arranged hammers each having a radially outer end are driven to undergo pivotal movement around their outer ends between front operating and rear rest positions. A first yoke member faces the radially arranged hammers, and has a plurality of cores opposed to the corresponding hammers and a dependent portion depending laterally from an outer periphery of the first yoke member to be magnetically coupled to the outer ends of the hammers. A plurality of coils are wound around respective ones of the cores to magnetically drive the corresponding hammers. A second yoke member has an outer periphery magnetically coupled to the dependent portion of the first yoke member and a plurality of tongues extending radially inwardly to define a plurality of slots between adjacent tongues to receive therein the hammers. A press spring acts on the respective outer ends of the hammers to urge the same pivotably against the dependent portion of the first yoke member to position the respective outer ends of the hammers in place relative to the dependent portion of the first yoke member. A plurality of printing elements are actuated by the respective hammers when driven to the front operating position for printing marks on a printing medium.

15 Claims, 4 Drawing Sheets

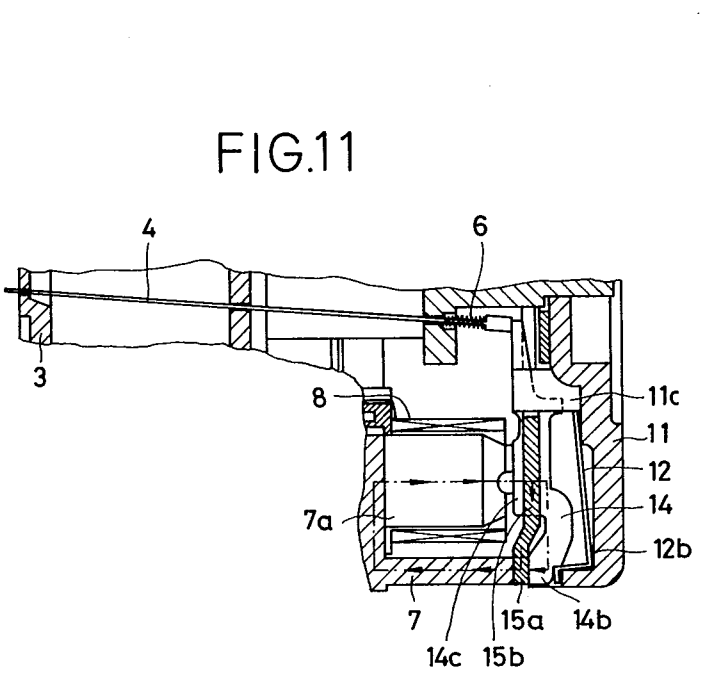
FIG.11
FIG.12
FIG.13
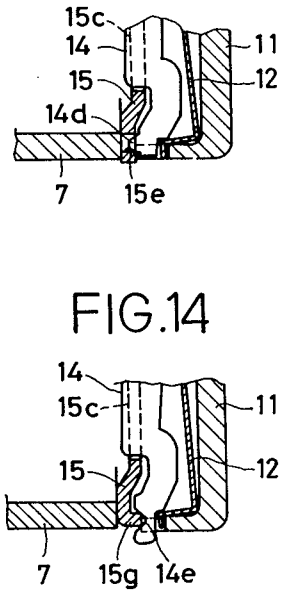
FIG.14
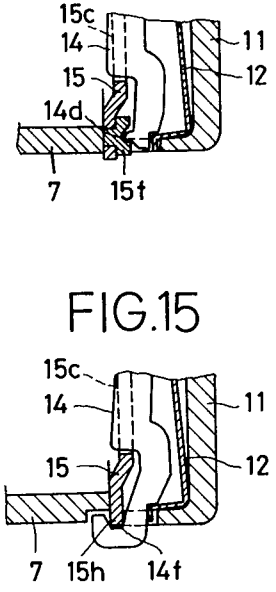
FIG.15
FIG.16

PRINTING HEAD WITH SPRINGS FOR PIVOTABLY HOLDING PRINTING HAMMERS

FIELD OF THE INVENTION

The present invention relates to an impact type dot matrix printer for forming characters, symbols, or the like in a dot matrix formation.

BACKGROUND OF THE INVENTION

In a conventional print head of this kind, print hammers are supported so as to be rotatable at a right angle to the main surfaces thereof and have movable yokes (armatures) which are mounted opposite to coil cores (see Japanese Patent Publication No. 35474/1983). In another print head of this kind, print hammers are supported so as to be rotatable along the main surfaces thereof. This hammer includes an armature disposed opposite to each coil core. The hammer is fabricated by blanking and bending a plate and the armature is integrally formed with the hammer (see Japanese Patent Publication No. 42471/1981).

The first-mentioned print head is comprised of a number of components and cumbersome to assemble, because the movable yokes are manufactured independent of the print hammers and then rigidly attached to the hammers. The second-mentioned head is laborious to manufacture, insomuch as it requires blanking, bending and other steps. In either print head, leaf springs, press plates, screws, or other similar parts are required to support the print hammers. Therefore, the conventional print head consists of a number of components, and is not easy to assemble. In addition, it is so difficult to arrange the hammers closely and actuate the hammers with a sufficient large magnetic forces.

SUMMARY OF THE INVENTION

It is an object of the present invention to provide a print head which has print hammers arranged closely and actuated with a sufficiently large magnetic force.

The above object is achieved by a print head for use in a printer of the impact type, comprised of print elements biased rearward by return springs, print hammers arranged radially and striking corresponding print elements, and a yoke body disposed in front of the print hammers and having coil cores which are disposed opposite to corresponding print hammers and on which coils are wound to actuate the hammers. The head is characterized by a further provision of a yoke plate for enhancing the efficiency with which the print hammers are magnetically actuated. The yoke plate has tongue portions which extend radially inward from its outer peripheral portion. The tongue portions are arranged alternately with, and close to, the print hammers. The yoke body has a lateral wall extending rearward in a parallel relation to the cores. The outer peripheral portion of the yoke plate is in contact with the rear end surfaces of the lateral wall.

Since the tongue portions of the yoke plate extend between the print hammers, the magnetic flux emanating from a coil core forms a first magnetic path which passes from the corresponding print hammer and back to the same print hammer through the yoke body. In addition, a second magnetic path is formed which passes from the core through the hammer, the neighboring tongue portions of the yoke plate, the outer peripheral portion of the yoke plate and the yoke body, and back to the same core. The print hammers shaped in the form of a plate are angularly movable along their main surfaces. Even if the magnetic flux saturates inside the hammer, the magnetic path passing through the neighboring tongue portions of the yoke plate is formed. Thus, the cores attract the hammers with a sufficient large force. Hence, the hammers can be actuated efficiently.

Other objects and features of the invention will appear in the description thereof which follows.

BRIEF DESCRIPTION OF THE DRAWINGS

FIG. 11 is a cross-sectional view of main portions of the print head shown in FIG. 1, for showing the manner in which the print hammer is actuated; and FIGS. 12–16 are cross-sectional views of main portions of other structures for supporting the print hammer.

DETAILED DESCRIPTION OF THE INVENTION

Figure 1:
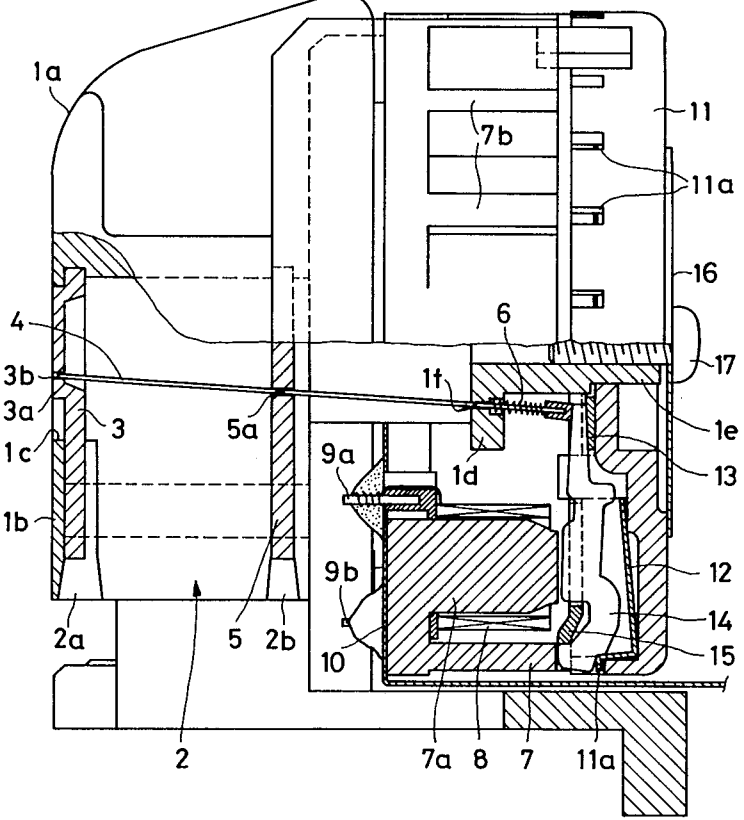
FIG. 1 is a cutaway side elevation view of main portions of a print head according to the present invention.

Referring to FIG. 1, there is shown a print head embodying the concept of the present invention. This head has a head frame 1 which is entirely made from a synthetic resin containing graphitic carbon. A guide plate support portion 1*a* protrudes from the center of the front half of the frame 1. The support portion 1*a* has a hollow 2 which is open at its lower end. The front wall 1*b* of the support portion 1*a* is provided with an opening 1*c* which is in communication with the hollow 2. The peripheral wall defining the front end of hollow 2 has a vertical groove 2*a* and a front guide 3 is inserted into the groove 2*a*. The guide 3 is introduced into the groove 2*a* from the bottom of the groove 2*a* and has a portion 3*a* protruding forward and fitted in the opening 1*c*. The front surface of the protruding portion 3*a* and the front wall 1*b* of the head frame 1 form a common plane. The protruding portion 3*a* has two rows of zigzag guide holes 3*b* in which the front ends of print elements 4, such as print wires, are slidably inserted. In this embodiment, twenty-four print elements 4 (only one is shown) are provided. The peripheral wall defining the rear end of the hollow 2 has a vertical groove 2*b* into which an intermediate guide 5 is inserted. When the head is assembled, the intermediate guide 5 is inserted into the groove from the bottom side. The intermediate guide 5 has twenty-four guide holes 5*a* arranged in an elliptic shape. The intermediate portions of the print elements 4 extend slidably through the guide holes 5*a*.

The head frame 1 further has a rear guide 1*d* disposed at the rear of the hollow 2 and spaced a given distance from the hollow 2, in order to guide the rear portion of the print elements 4. A post-like connector portion 1*e* protrudes rearwards from the center of the rear end guide 1*d*, which is provided with twenty-four guide holes 1*f* arranged in a circular shape. At the rear portions of the print elements 4 which extend through the holes 1*f*, return springs 6 are mounted. Thus, each print element 4 is biased rearwards.

Figure 2:
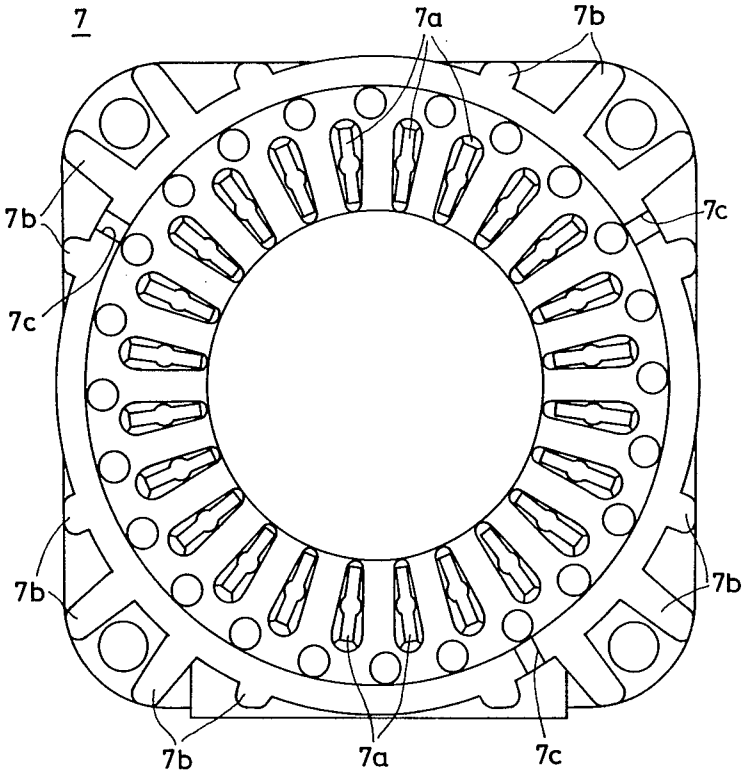
FIG. 2 is a rear view of the yoke body shown in FIG. 1.
Figure 4:
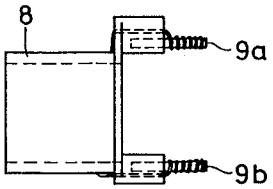
FIG. 4 is a right side elevation view of the coil shown in FIG. 3.
Figure 3:
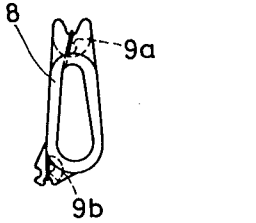
FIG. 3 is a rear view of the coil shown in FIG. 1.

A mechanism for striking the print elements 4 is now described. A first cylindrical yoke member 7 (FIG. 2) is mounted behind the head frame 1. A number of coil cores 7*a* corresponding to that of the print elements 4 (twenty-four in this embodiment) protrude rearward from the yoke member 7, and are arranged circumferentially on the yoke member 7. Each core 7*a* has a coil 8 (FIGS. 3 and 4) wound around respective one of the cores 7*a* to actuate the corresponding print hammer (described latter). Each core 7*a* further includes terminal pins 9*a*, 9*b* protruding toward the front surface of the yoke member 7. A flexible cable 10 is connected to the pins 9*a* and 9*b*. Radiating fins 7*b* are formed integrally on the outer periphery of the yoke member 7. The connector portion 1*e* extends through the center of the yoke member 7 and protrudes rearward.

A head cover 11 (FIG. 5) has a lateral wall opposed to the rear end surface of the lateral wall of the yoke member 7 which extend parallel to the cores 7*a*. The lateral wall of the cover 11 has twenty-four grooves 11*a*. The cover 11 has a center hole 11*b* through which the connector portion 1*e* extends. Twenty four guide protrusions 11*c* are formed around the center hole 11*b*. A press spring 12 (FIG. 6) is housed in the cover 11. The spring 12 has an annular hub 12*a* fitted around the protrusions 11*c* and twenty-four finger-like resilient arms 12*b* extending outwardly radially from the annular hub 12*a*. The distal ends of the resilient arms 12*b* extend into the grooves 11*a* in the cover 11. An annular damper 13 is received inside the protrusions 11*c*.

Figures 7, 8, 9, 10:
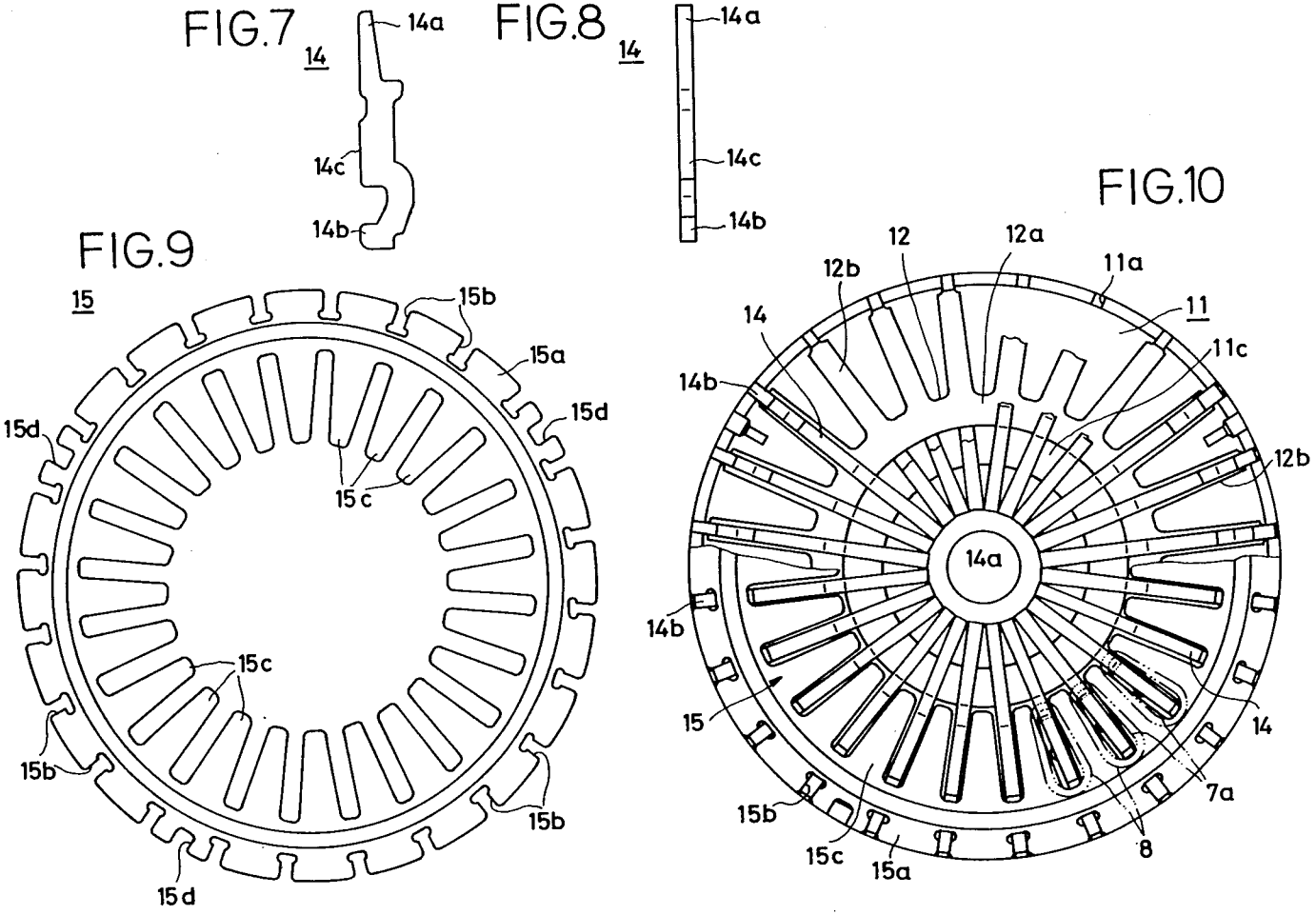
FIG. 7 is a side elevation view of the print hammer shown in FIG. 1.
FIG. 8 is a front elevation view of the print hammer shown in FIG. 1.
FIG. 9 is a front elevation view of the yoke plate shown in FIG. 1.
FIG. 10 is a cutaway front elevation view of the yoke plate shown in FIG. 9, and in which some components have been mounted to the yoke plate.

Twenty four print hammers 14 (FIGS. 7 and 8) are mounted in front of the resilient arms 12*b* of the press spring 12. Each hammer 14 having a shape, as shown in FIGS. 7 and 8, pressed out of a sheet plate. Each hammer 14 is radially arranged so that its inner end portion 14*a* is disposed between the neighboring protrusions 11*c*. The rear ends of the print elements 4 face corresponding front inner ends of the hammer 14. The radially outer end portions 14*b* of the hammers 14 are inserted in the grooves 11*a*. Each hammer 14 has an intermediate protruding portion 14*c* in its center in opposed relation to the corresponding. core 7*a*.

The outer peripheral portion 15*a* of a yoke plate or second yoke member 15 (FIG. 9) is in contact with the rear end surfaces of the lateral wall or dependent portion of the yoke member 7 depending laterally from an outer periphery of the first yoke member 7. The outer peripheral portion 15*a* is provided with grooves 15*b* facing the grooves or openings 11*a*. The outer end portions 14*b* of the hammers 14 are located within the corresponding grooves 11*a* and 15*b* such that the outer ends 14*b* of the hammers 14 are brought into contact with the end of the dependent portion of the first yoke member 7. Tongue portions 15*c* extend radially inward from the outer peripheral portion 15*a* and are arranged alternately with the hammers 14 to define a plurality of slots between adjacent tongue portions 15*c* to receive therein the hammers 14.

Figure 6:
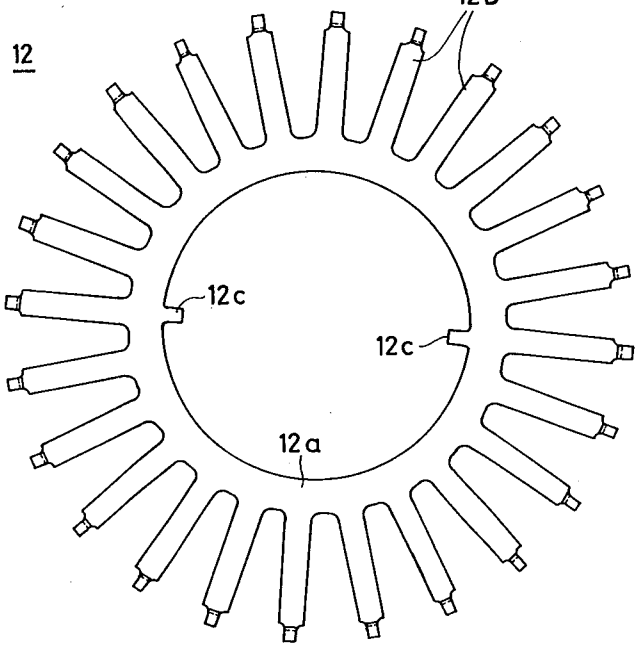
FIG. 6 is a front elevation view of the press spring shown in FIG. 1.
Figure 5:
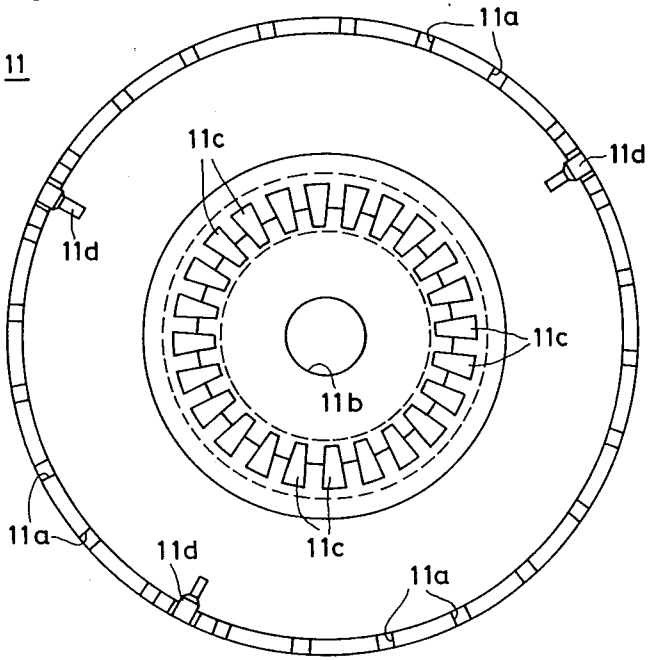
FIG. 5 is a front elevation view of the head cover shown in FIG. 1.

Referring to FIG. 5, the head cover 11 has protrusions 11*d* for placing the yoke member 7 and the yoke plate 15 in position. These protrusions 11*d* fit in positioning grooves 7*c* (FIG. 2) and in positioning grooves 15*d* (FIG. 9). Referring to FIG. 6, positioning protrusions 12*c* are integrally formed on the press spring 12 toward the head cover 11 and fit between the adjacent protrusions 11*c* (FIG. 5).

When the print head is assembled, the press spring 12 and the print hammers 14 are inserted into the head cover 11. Then, the rear surface of the outer peripheral portion of the yoke plate 15 is brought into contact with the front end surface of the lateral wall of the cover 11 in the arrangement shown in FIG. 10. Thereafter, the front surface of the outer peripheral portion of the yoke plate 15 is brought into contact with the rear end surface of the lateral wall of the yoke member 7.

The fringe of a fixing leaf spring 16 is brought into resilient contact with the rear surface of the cover 11. A screw 17 is passed through the leaf spring 16 and screwed into the connector portion 1*e*. Thus, the rear end surfaces of the print elements 4 are in contact with the front end surfaces of the radially inner end portions 14*a* of the hammers 14. The resilient arms 12*b* of the press spring 12 push or act on the rear end surfaces of the outer end portions 14*b* of the hammers 14, bringing the front end surfaces of the outer end portions 14*b* into resilient contact with the rear end surface of the lateral wall of the yoke member 7 to urge the radially outer end portions 14*b* against the lateral wall of the yoke member 7 to rotatably position the respective outer ends of the hammers in place relative to the lateral wall of the yoke member 7. In this way, the hammers 14 are received so as to be rotatable or pivotable about their radially outer end portions between front operating and rear rest positions in an axial direction transverse to the radial directions of the hammers 14.

We now describe the operation of one of the print elements 4 and its associated components. It is to be understood that any other print element 4 and its associated components function in the same manner. When the coil 8 corresponding to the print element 4 is not energized, the print hammer 14 is pushed rearwards in the rear rest position so that its inner end is in resilient contact with the damper 13 by the action of the return spring 6 of the print element 4. Under this condition, the intermediate protruding portion 14*c* is not in contact with the core 7*a*. When the coil 8 is energized to excite the core 7*a*, the protruding portion 14*c* of the print hammer 14 is attracted to the core and makes contact with it as shown in FIG. 11 in the front operating position. This moves the inner end portion 14*a* of the hammer 14 forward, pushing and actuating the print element 4 forward. The magnetic flux emanating from the core 7*a* passes from the protruding portion 14*c* of the hammer 14 to the yoke member 7 through the outer end portion 14*b* of the hammer magnetically coupled to the dependent portion of the yoke member 7, and then returns to the core 7*a*. Also, the flux originating from the core 7*a* passes form the protruding portion 14*c* of the hammer 14 to the yoke member 7 through the neighboring tongue portions 15*c* and the outer peripheral portion 15*a* of the yoke plate 15 magnetically coupled to the dependent portion of the yoke member 7, and then returns to the core 7*a*. Therefore, even if the hammer 14 is shaped in the form of a thin plate and does not have a sufficiently large area of cross section, the hammer 14 is actuated with a sufficiently large magnetic attraction, impacting the print element 4.

It is to be understood that the structure for supporting the print hammers 14 is not limited to the structure of the above embodiment, but rather various support structures as shown in FIGS. 12–16 can be employed. In the embodiment shown in FIG. 12, a small protrusion **14*d* is formed on the outer end of the print hammer 14. This protrusion 14*b* is fitted in a hole 15*e* formed in the yoke plate 15, so that the hammer 14 is rotatably received. In the embodiment shown in FIG. 13, a receiver member 15*f* for receiving the small protrusion 14*d* is manufactured independently and is fixed to the yoke plate 15. In the embodiment shown in FIG. 14, a vertically bent portion 15*g* is formed integrally with the yoke plate 15 and extends laterally from the outer peripheral portion of the plate 15. The bent portion 15*g* is received in a V-shaped groove 14*e* formed at the outer end of the hammer 14. In the embodiment shown in FIG. 15, the fringe 15*h* of the yoke plate 15 is received in a V-shaped groove 14*f* formed in the hammer 14. Thus, the hammer 14 is rotatably supported. In this case, the outer peripheral portion of the plate 15 is not bent but rather extended in the radially outward direction. In the embodiment shown in FIG. 16, a protrusion 14*g* which is formed on the outer end of the hammer 14 bears on the outer surface of the yoke frame 7. The hammer 14 can rotate about this protrusion. The yoke plate 15 has a groove 15*j* at its outer end. The outer end portion cf the hammer 14 is fitted in the groove 15*j*** and placed in position.

In accordance with the present invention, since a magnetic path passing form the core and back to the core through the print hammer and the yoke member is formed and, in addition, also a magnetic path passing from the core and back to the core through the print hammer, the yoke plate, and the yoke member is formed, a magnetic efficiency is improved. Hence, it is possible to obtain a sufficiently large force to actuate the hammers.

What is claimed is:

1. A print head comprising:

a plurality of print elements including return springs for rearwardly biasing the printing elements;

a plurality of print hammers arranged radially and supported so as to be angularly movable about their radially outer ends from their rest position toward the print elements;

a yoke member disposed in front of the print hammers and having a plurality of coil cores and a plurality of coils wound around respective ones of the coil cores to actuate the print hammers, the coil cores being opposed to the print hammers, the yoke member further having a lateral wall extending rearward in parallel relation to the coil cores, the lateral wall having a rear end surface in contact with the radially outer ends of the printing hammers;

a yoke plate having a plurality of tongue portions which extend radially inward from its outer peripheral portion and which are arranged alternately with, and close to, the print hammers, the outer peripheral portion being in contact with the rear end surface of the lateral wall of the yoke member, the outer peripheral portion having a plurality of grooves for receiving therein the respective ones of the radially outer ends of the print hammers; and a press spring having a plurality of resilient arms for pressing the respective ones of the radially outer ends of the print hammers against the rear end surface of the lateral wall of the yoke member to place the print hammers in their rest position.

2. A printing head for printing marks on a printing medium, comprising: a plurality of radially arranged hammers each having a radially outer end and being driven to undergo pivotal movement around their outer ends between front operating and rear rest postions in an axial direction transverse to the radial directions of the hammers; drive means including a first yoke member facing the radially arranged hammers and having a plurality of cores opposed to the corresponding hammers and a dependent portion depending laterally from an outer periphery of the first yoke member to be magnetically coupled to the outer ends of the hammers, a plurality of coils wound around respective ones of the cores to cause the cores to magnetically drive the corresponding hammers, and a second yoke member having an outer periphery magnetically coupled to the dependent portion of the first yoke member and a plurality of tongues extending radially inwardly from the outer periphery of the second yoke member to define a plurality of slots between adjacent tongues to receive therein the hammers; spring means acting on the respective outer ends of the hammers to resiliently urge the same against the dependent portion of the first yoke member to pivotably position the respective outer ends of the hammers in place relative to the dependent portion of the first yoke member; and a plurality of printing elements actuated by the respective hammers when driven to the front operating position for printing marks on a printing medium.

3. A printing head according to claim 2; wherein the spring means comprises a hub, and a plurality of resilient arms extending radially outwardly from the hub and having respective distal ends acting on the corresponding outer ends of the hammers.

4. A printing head according to claim 3; wherein the hub comprises an annular hub.

5. A printing head according to claim 2; wherein the second yoke member has an outer periphery disposed in contact with an end of the dependent portion of the first yoke member.

6. A printing head according to claim 5; wherein the outer periphery of the second yoke member has a plurality of openings for receiving therein the respective outer ends of the hammers such that the outer ends of the hammers are brought into contact with the end of the dependent portion of the first yoke member.

7. A printing head according to claim 5; wherein the outer periphery of the second yoke member has a plurality of receiving members fixed thereto for receiving thereon the respective outer ends of the hammer.

8. A printing head according to claim 7; wherein each of the hammer outer ends has a protrusion received in the corresponding receiving member.

9. A printing head according to claim 5; wherein the outer periphery of the second yoke member has a bent portion extending laterally therefrom, and each of the hammer outer ends has a groove for receiving therein the bent portion.

10. A printing head according to claim 5; wherein the outer periphery of the second yoke member has a fringe extending radially outwardly therefrom, and each of the hammer outer ends has a groove for receiving therein the fringe.

11. A printing head according to claim 10; wherein each of the hammer outer ends has a protrusion adjacent to the groove in contact with an outer surface of the dependent portion of the first yoke member.

12. A printing head according to claim 2; wherein the dependent portion of the first yoke member has a plurality of cavities in the end thereof, and each of the hammer outer ends has a protrusion pivotably received in respective one of the cavities.

13. A printing head according to claim 2; wherein each of the hammers has a radially inner end acting on respective ones of the printing elements.

14. A printing head according to claim 13; wherein each of the hammers has an intermediate portion between the inner and outer ends disposed in respective ones of the slots of the second yoke member and opposed to the corresponding core of the first yoke member.

15. A printing head according to claim 13; wherein each printing element includes a return spring for urging the printing element rearwardly so that the printing element acts on the radially inner end of the corresponding hammers to hold the hammer in the rear rest position.

* * * * *